United States Patent [19]

Ecklund et al.

[11] Patent Number: 4,916,928

[45] Date of Patent: Apr. 17, 1990

[54] STOPS FOR CURVED SPF/DB SANDWICH FABRICATION

[75] Inventors: Richard C. Ecklund, Lakewood; Masashi Hayase, Fountain Valley; Robert J. Walkington, Garden Grove, all of Calif.

[73] Assignee: McDonnell Douglas Corporation, Long Beach, Calif.

[21] Appl. No.: 318,967

[22] Filed: Mar. 6, 1989

Related U.S. Application Data

[62] Division of Ser. No. 187,601, Apr. 28, 1988, Pat. No. 4,833,768.

[51] Int. Cl.[4] ..... B21D 22/10; B21D 28/18; B21D 39/20

[52] U.S. Cl. ..... 72/60; 72/347; 72/709; 228/157

[58] Field of Search ..... 29/157.3 D, 421.1, 445; 72/60, 347, 709; 228/157, 183

[56] References Cited

U.S. PATENT DOCUMENTS

| | | | |
|---|---|---|---|
| 948,818 | 2/1910 | Lindholm | 72/347 |
| 2,582,358 | 1/1952 | Schoellerman | 29/421.1 |
| 3,024,525 | 3/1962 | Wisberger | 29/421.1 X |
| 3,077,031 | 2/1963 | Fromson | 29/421.1 |
| 3,340,101 | 9/1967 | Fields, Jr. et al. | 72/60 X |
| 4,217,397 | 8/1980 | Hayase et al. | 228/157 X |
| 4,304,821 | 12/1981 | Hayase et al. | 228/157 |
| 4,331,284 | 5/1982 | Schulz | 228/157 |
| 4,549,685 | 10/1985 | Paez | 228/157 X |
| 4,713,953 | 12/1987 | Yavari | 72/60 |

FOREIGN PATENT DOCUMENTS

| | | | |
|---|---|---|---|
| 2438232 | 2/1975 | Fed. Rep. of Germany | 72/709 |
| 166127 | 8/1985 | Japan | 72/60 |

*Primary Examiner*—Charlie T. Moon

*Attorney, Agent, or Firm*—Paul T. Loef; George W. Finch; John P. Scholl

[57] ABSTRACT

The process for forming a metallic sandwich structure having a curved surface, particularly a surface curving about more than one axis, such as a quadric surface partially by direct displacement and partially by a fluid interface. Additionally, means to restrain the work sheets being formed with respect to the shaping fixture which allow a portion of the work sheets to flow into the forming cavity before absolute restraint is applied and the restraining means function independently of the clamping force of the press.

4 Claims, 1 Drawing Sheet

FIG. 1.
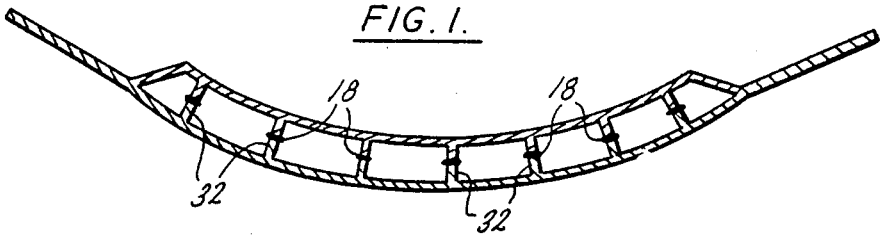
FIG. 2.
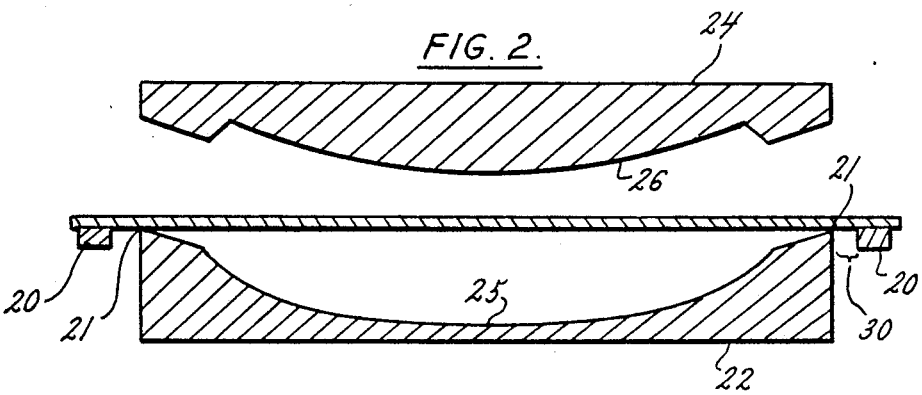
FIG. 3.
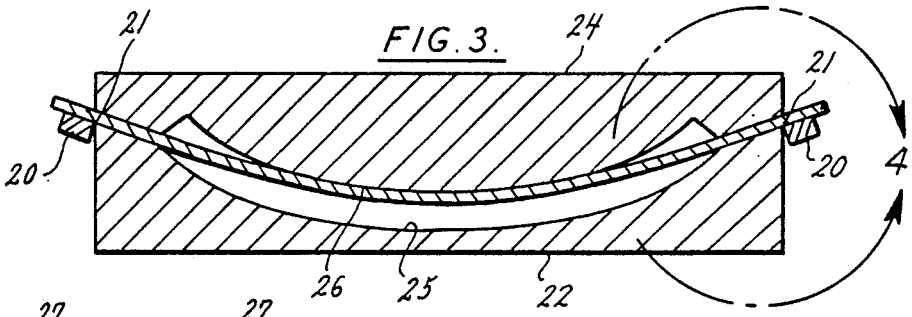
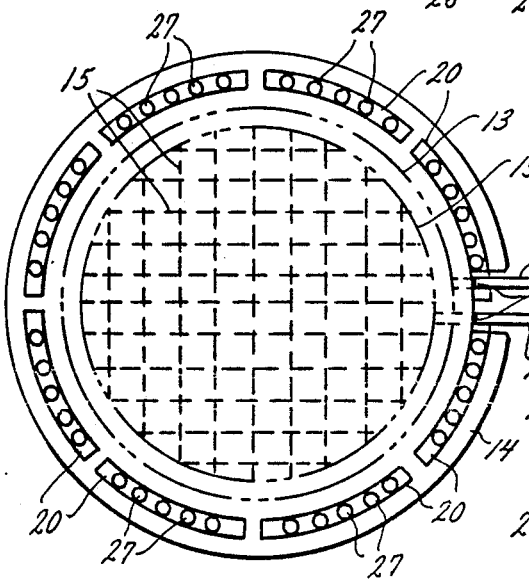
FIG. 5.
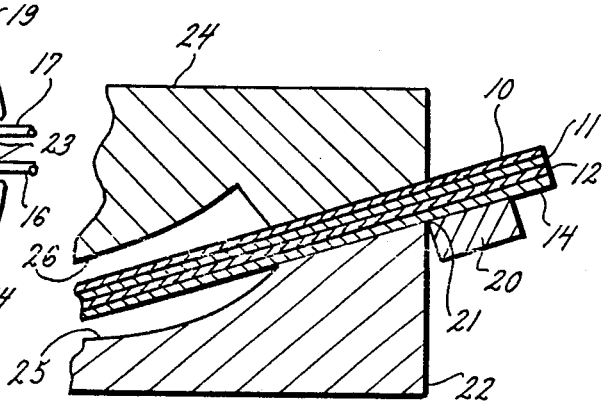
FIG. 4.

STOPS FOR CURVED SPF/DB SANDWICH FABRICATION

This is a division of application Ser. No. 187,601, filed Apr. 28, 1988, now U.S. Pat. No. 4,833,768.

BACKGROUND OF THE INVENTION

This invention pertains to the production of superplastically formed, complex, metal alloy structures, and more particularly to these structures having curved surfaces.

Superplasticity is the characteristic demonstrated by certain metals that develop unusually high tensile elongation with a minimum necking when deformed within a limited temperature and strain rate range. This characteristic, peculiar to certain metal and metal alloys has been well known in the art. It is also well known that at these same superplastic forming temperatures, some materials will fusion bond with the application of pressure at the contacting surfaces.

U.S. Pat. Nos. 4,217,397 and 4,304,821 to Hayase et al and assigned to the same assignee as the instant case teaches the process for making a sandwich structure in which metal work sheets are joined in a preselected pattern by an intermittent weld. The joined sheets are sealed by a continuous weld to form an expandable envelope. The application of inert gas pressure to the envelope in a fixture superplastically produces the sandwich structure. Core configuration of the structure is determined by the intermittent weld pattern. The face sheets of the sandwich structure may be formed from one sheet of the envelope or may be inserted in the limiting fixture and the envelope expanded against the face sheets. The contents of U.S. Pat. No. 4,217,397 and 4,304,821 are incorporated herein by reference.

Basically, the process as taught in these two patents is limited to producing a core structure which is flat, i.e., the face sheets are flat and not curved. Although they suggest preforming the face sheets for complex shapes, as a practical matter, this technique is effective only wit very limited curvature. The most difficult and complex part of this procedure is welding the preformed core sheets. In addition to the welding, preforming is an added complex operation because it requires precision forming or the welding cannot be satisfactorily performed. In the typical four-sheet process a different die radius is required for each of the two face sheets and a third radius is required for the welded work sheets forming the envelope which is expanded to produce the core.

U.S. Pat. No. 4,113,522 to Hamilton et al and U.S. Pat. No. 3,340,101, to D. S. Fields, Jr., et al and an article which appeared in Steel magazine of Dec. 15, 1962 entitled "Superplasticity Enchants Metallurgy," by Professor Walter A. Backofen of Massachusetts Institute of Technology, all teach some type of two-step operation. They include means for at least Partially deforming the material by direct displacement (rather than through a fluid interface) and a second phase through a fluid interface which may occur before or after the direct displacement. However, all of these references teach superplastic forming of single sheets. Furthermore, all of these references teach retention of the sheet being formed by clamps. Professor Backofen shows ten ways to form superplastically. Although he identifies the retention means as a clamp, he illustrates it as a stop, which is believed to be intended as a schematic representation of a clamp because in certain methods, e.g., with the billow plug, billow snapback, air slip, and plug assist and air slip, if it were a stop alone, as illustrated, it would not work. No discussion of these methods is contained in the article.

There are a couple of other points which are significant by way of background. First, it is important to note that the secret to all superplastic forming is to keep the part being formed in tension, as any compression results in buckling and consequent wrinkles in the final part. Second, many alloys are being developed, particularly aluminum alloys, which demonstrate superplastic characteristics, but do not readily diffusion bond. Basically, all that has been taught in superplastic forming in combination with diffusion bonding applies to the more difficult alloys to bond, except that some subsequent alternate step must be taken to perfect the bonding, such as welding, brazing or bonding, all of which are known in the art.

Further, by way of background, typically when forming the multi-sheet envelope by fluid pressure, the material being formed is retained in the forming fixture by the hydraulically actuated portion of the press, which acts as a huge clamp, generally acting through a split forming die. However, when you are superplastically forming metal partially by direct displacement phase, and partially by a fluid interface, the hydraulically actuated portion of the press is required for the direct displacement phase, and some other means must be devised to retain the sheets being formed during the fluid interface phase. Double acting presses can be adapted to perform both functions, however, these presses are complex and expensive and are generally not readily available. It is highly desirable that in a single acting press, both the direct displacement and fluid interface forming are to be performed in one shaping die without removing a partially formed part between these steps. Hence, some other means must be devised to retain the sheets being formed during both forming operations.

It is an object of this invention to produce a curved sandwich structure by creep forming face sheets and/or the envelope to be expanded by direct displacement and further expanding some or all of the elements by a fluid interface.

It is a further object of this invention to provide means for retaining or holding sheets to be formed into the sandwich structure other than the press itself.

It is yet a further object of this invention to provide means within the means for retaining the sheets to be formed to provide excess material for the forming operation so as to minimize the thinning in the high-strained areas or control material thicknesses.

Another object of this invention is to perform the entire forming process in one forming fixture without a need for removing a partially formed structure for intermittent steps.

SUMMARY OF THE INVENTION

Briefly, and in general terms, the present invention teaches the method for making a metallic sandwich structure having a curved surface, particularly a surface curving about more than one axis, e.g., a quadric surface, from a plurality of metal work sheets. Generally, two contiguous work sheets are joined together by a discontinuous seam weld for some means to allow gas flow between cells in a preselected pattern which determines the geometry of the structure of the core to be produced. An expandable core envelope is then formed by inserting an expansion tube and sealing the perimeter of the joined sheets. A second (face sheet) envelope enclosing the core sheet envelope is generally similarly formed by placing the face sheets on top and bottom of the core envelope, inserting a second expansion tube for this envelope and sealing the perimeter. The sealing perimeter of both envelopes must be at a location which will be inside the shaping fixture when the fixture is closed. The two envelopes, one inside the other, are then placed within a limiting fixture having opposing male and female surfaces. Means must be provided to retain or hold the stacked work sheet envelopes with relationship to the fixture. The space between the male and female surfaces of the fixture, of course, control the height and shape of the sandwich structure. The work sheet envelopes are then heated to a temperature suitable for creep forming, but lower than the diffusion bonding temperature of the work sheets, and the fixture is slowly closed so that the male surface of the fixture directly displaces or creep forms the work sheets towards the female surface of the fixture. Then, without any need for opening the shaping fixture, the work sheets are heated to a more optimum temperature for superplastic forming and gas pressure is applied to both the expandable envelopes causing the work sheets to expand about the discontinuous welds to form the face sheets first, followed by the core sheets to form a curved sandwich structure.

The means to hold the work sheet envelopes during the forming operation is critically important. In the preferred embodiment, the means used to retain the work sheets during the forming operation permits a variable but predetermined amount of the work sheet material to flow into the shaping fixture before absolute restraint is applied. This is most easily accomplished by welding a metal strip to the perimeter of the work sheet at a location which will be outside the perimeter of the shaping fixture when closed so that the metal strip can engage a lip on the shaping fixture and provide a positive restraint. The strip may be continuous or intermittent. Varying the spacing between the metal strip and lip on the fixture determines the amount of material that flows into the fixture before the strip or stop engages the shoulder so as to provide an absolute restraint.

BRIEF DESCRIPTION OF THE DRAWINGS

With reference to the drawings, wherein like reference numbers designate like portions of the invention:

FIG. 1 is a cross sectional view of a portion of a spherical surface formed by the method of this invention;

FIG. 2 is a sectional view of the shaping fixture and the work sheet prior to forming the curved structure shown in FIG. 1;

FIG. 3 is the same view as FIG. 2 except the fixture is closed, the direct displacement forming has been completed, but prior to superplastic forming with a fluid interface; and FIG. 4 is an enlarged view of a portion of FIG. 3 showing the stops and the four sheets of this particular embodiment of the process which produced the structure of FIG. 1; and FIG. 5 is a bottom view of the double envelope work sheet with stops, weld pattern, seals, and expansion tubes shown;

DESCRIPTION OF THE PREFERRED EMBODIMENT

A four work sheet metal envelope assembly prior to being formed into the curved sandwich structure of FIG. 1 is shown in FIG. 2 along with the shaping fixture. However, the four worksheets are best shown in the enlarged partial view of FIG. 4. There are two face sheets, 10 and 14, and two interior or core sheets 11 and 12. Superplastic, interior or core sheets 11 and 12 are jointed by a discontinuous or intermittent weld or bond, in a predetermined pattern, as shown by the broken lines 15, which in the dome structure illustrated were one (1) inch on centers. The pattern of the intermittent weld determines the configuration of the core.

The discontinuous weld which joins the core work sheets 11 and 12 may be of any type weld or bond so long as it remains welded at the superplastic forming temperatures. However, the width of the weld affects the shape of the web formed after the core is expanded as shown at 18 in FIG. 1. The micro-structure of the material subjected to the weld, in most alloys, has been changed to the extent that it has been rendered non superplastic. Consequently, the weld retains its preform shape after forming. At this time, at least, an intermittent roll seam weld, which is nothing more than a series of spot welds, is the preferred method of joining the core sheets. The discontinuities or interruptions in the weld must be sufficient to provide vent holes to balance the gas pressure between the cells of the core structure during the forming process. The two interior core sheets 11, and 12 are then sealed by a continuous weld near the perimeter, but the location of the weld must be such that it is included within the limiting fixture when the fixture is closed. This weld line is shown by the phantom line 19 in FIG. 5. The core envelope is locally deformed between work sheets 11 and 12 to provide a receptacle generally matching the outside diameter of the core expansion tube 16. The tube 16 is then butt welded, as shown at 23, to the receptacle so provided to form a joint end seal. The continuous seam weld 19 begins at one side of the expansion tube 16 and ends at the other side to complete the inflatable core envelope for gas pressurization to form the core.

Likewise, the face sheets 10 and 14 are also locally deformed to provide a second receptacle generally matching the outside diameter of the face sheet expansion tube 17. The tube 17 is also butt welded to this receptacle to again provide a joint and seal. The face sheet envelope is then sealed by applying a continuous seam weld at a slightly larger diameter shown by the phantom line 13, again around the perimeter of the envelope beginning at one side of the expansion tube 17 and ending at the opposite side of the tube 17 to provide a separate and additional inflatable face sheet envelope, for separate gas pressurization. So we have two envelopes, a core sheet envelope inside of a face sheet envelope.

Unless you are going to use a double acting press, which is essentially two presses in one, you need to provide some means for retaining or holding the work sheets during the forming process. Even in a double acting press, the fixture has to be sized and designed to match the press so that one half of the press acts to hold the work sheets with respect to the fixture by pressure or force against the Perimeter of the work sheets.

At any rate, this invention teaches a novel stop 20, which is shown welded to the stacked four work sheets in which the core sheets 11 and 12 have been previously joined or sealed at 19 and the face sheets sealed at 21. Stop 20 must be welded to the work sheet (shown as spot welds 27) such that it holds all four sheets. Although shown somewhat out of proportion so as to clearly show the function of the stop, the actual stop used in the structure shown in FIG. 1 was a ⅛ inch thick by 1 inch wide strip of metal welded to the outer perimeter of the face sheets. However, the shape and size of the stop is a function of the severity of the shaping and the geometry of the mating part, which here is a lip 21, shown on the lower half 22 of the shaping fixture. The shaping fixture is completed by the upper half 24.

Obviously, the interior shape of the two halves 22 and 24 of the shaping fixture determine the shape of the structure to be formed. The stacked work sheets 10, 11, 12, and 14, which have been joined together in combination with the stop 20, are placed over the lower half of the fixture 22 with the stop 20 oriented to engage the lip 21 and align with the upper half of the fixture 24 having a male surface 26.

The press, along with the four work sheets, (two envelopes) is heated to a temperature less than the diffusion bonding temperature of the material if the material being formed is diffusion bondable. This is critical, as you can't have any diffusion bonding at this step of the process. Now, the press is slowly closed so that the male surface 26 of the upper fixture engages the face sheet 10 and slowly deforms by direct displacement, all four of the work sheets, 10, 11, 12, and 14 until the fixture is closed, as shown in FIG. 3. Of course, the rate of closure, or deformation of the work sheets, which we shall call creep forming, is a function of the material, temperature, and the severity of the deformation. Some time before the two halves of the fixture 22 and 24 close completely, the stops 20 engage the lip 21. The gap 31 between the lip 21 and the stop 20 prior to any deformation is limited by the requirement, discussed earlier, that the part being formed must always be in tension, because if it sees any compression it will wrinkle.

The temperature of the fixture and the material being formed is then raised to a more optimum superplastic forming temperature and a temperature at which the material being formed will diffusion bond if the material is diffusion bondable. The face sheet envelope (sheets 10 and 14) is expanded first by the application of an inert gas at the tube 17. Because of the large span, the face sheets will expand much faster than the core sheets (sheets 11 and 12), which are short spans due to the intermittent welds which form the core. However, pressure must be maintained on both envelopes at all times while superplastically forming with the fluid interface; it is essential to keep the core sheets separated to prevent diffusion bonding. Even after the face sheets are blown against surfaces 25 and 26 of the shaping fixture, pressure must be maintained on the face sheet or, when the core is formed, it will draw the face sheets where the webs 32 are formed and the result will be scoring of the outer surfaces. The actual pressures to superplastically form are in the hundred psi range, however, the actual pressure for any structure varies with the spans being formed. Because of the short spans in the core envelope, it is always at a higher pressure than the face sheet envelope.

The strain rate, important to balanced and stable forming, is determined by the rate of change of the differential gas pressure across the envelope being expanded in conjunction with the particular structural spans involved in the envelope being expanded to form the core. Therefore, the gas pressure in the envelopes being expanded is increased at a predetermined rate, which may be determined experimentally or calculated for the particular structure involved. The pressure within the compartment of the core sheet envelope is maintained equal by the vent holes provided by the cessation, or discontinuities in the intermittent seam welds shown as the dotted lines identified as 15. It may be necessary with some core structures to increase the expansion pressure at prescribed rates, stopping at several pressure levels to allow the pressure within the envelope compartments to equalize. As the core expands and contacts the inner surfaces of the face sheets 10 and 14, the core sheets 11 and 12 are diffusion bonded to the face sheets if the material being formed is diffusion bondable.

The core sheet envelopes expand to meet the inner surface of the previously expanded face sheets and is characterized by displacement of the intermittent weld shown at 15 in FIG. 5. The top and bottom surfaces of the weld are totally enveloped by the parent material and located at the mid point in the vertical walls of the structure as shown at 18. However, it is to be understood, that no line exists at any interface between any two sheets being formed as the surfaces are diffused together to form a unified whole.

The sandwich structure illustrated and described above is a four work sheet, two envelope combination. However, it should be reasonably clear that a three work sheet envelope or a two work sheet, i.e., a single envelope can be expanded to produce a variation of the structure.

While a particular embodiment of the invention has been described and illustrated, it should be understood that various changes and modifications can readily be made within the spirit of the invention. The invention, accordingly is not be taken as limited except by the scope of the appended claims.

We claim:

1. A device for restraining at least two substantially planar peripherally secured work sheets to be deformed in a split limiting fixture which comprises a pair of having opposing first and second surfaces, said first surface having a protruding convex portion and said second surface having a cavity to produce a curved surface partially by direct displacement and partially by a fluid interface;

first means attached around the perimeter of said work sheets so as to provide a stop for said work sheets with respect to said split limiting fixture; and second means attached to the outer edge of said dies of said split limiting fixture to engage said first means attached to the perimeter of said work sheets during the partially deforming by a fluid interface between said sheets to shape one of said sheets into said cavity to produce a curved surface thereon.

2. The device of claim 1 wherein said first means attached to the perimeter of said work sheets is located so as to be spaced from said second means attached to said split limiting fixture before forming said work sheets.

3. The device of claims 1 or 2 wherein said first means attached to the perimeter of said work sheets is a metal stop welded to said work sheets.

4. The device of claims 1, 2 or 3 wherein said second means is a lip on said second surface of said split limiting fixture.

* * * * *